US011198922B1

(12) United States Patent
Clift

(10) Patent No.: US 11,198,922 B1
(45) Date of Patent: Dec. 14, 2021

(54) MERCURY COLLECTION SYSTEM

(71) Applicant: Mercury Clean Up, LLC, Sacramento, CA (US)

(72) Inventor: Paul Milton Clift, Marysville, CA (US)

( * ) Notice: Subject to any disclaimer, the term of this patent is extended or adjusted under 35 U.S.C. 154(b) by 0 days.

(21) Appl. No.: 17/284,264

(22) PCT Filed: Oct. 29, 2020

(86) PCT No.: PCT/US2020/057960

§ 371 (c)(1),
(2) Date: Apr. 9, 2021

(51) Int. Cl.
*C22B 43/00* (2006.01)
*B03B 5/56* (2006.01)
*B03B 9/00* (2006.01)

(52) U.S. Cl.
CPC ..... *C22B 43/00* (2013.01); *B03B 5/56* (2013.01); *B03B 9/00* (2013.01)

(58) Field of Classification Search
CPC ..... B03B 5/56; B03B 9/00; C22B 43/00
USPC ..... 75/721
See application file for complete search history.

(56) References Cited

U.S. PATENT DOCUMENTS 1,041,909 A * 10/1912 Trent ..... B03B 5/56 209/451
1,698,442 A * 1/1929 Lockett ..... B03B 5/56 209/452
1,835,169 A * 12/1931 Marshall ..... C22B 43/00 266/145
1,992,288 A * 2/1935 Cave ..... B03B 5/56 209/44
2,099,133 A * 11/1937 Munro ..... B03B 5/56 209/452
2,156,192 A * 4/1939 Pluschke ..... C22B 43/00 266/145
4,098,648 A * 7/1978 Kraemer ..... B03B 5/56 196/14.52
5,013,358 A 5/1991 Ball et al.
5,102,630 A 4/1992 Lee
5,183,499 A 2/1993 Chintis
5,226,545 A 7/1993 Foust
5,244,492 A 9/1993 Cyr
(Continued)

FOREIGN PATENT DOCUMENTS

AT 503283 B1 * 9/2007 ..... B03B 5/56
EP 0998981 A2 * 5/2000 ..... A23N 12/023
(Continued)

OTHER PUBLICATIONS

HCET Report. "Mercury Contaminated Material Decontamination Methods: Investigation and Assessment". U.S. Department of Energy. Jan. 2001.

*Primary Examiner* — Terrell H Matthews
(74) *Attorney, Agent, or Firm* — Jeffrey G Sheldon; Katherine B. Sales; Cislo & Thomas LLP

(57) ABSTRACT

A system for collecting mercury from feed material that can be tailings comprises: a water inlet for forming a slurry containing the tailings; at least one screen for separating tailings greater than ¼ inch in diameter from the slurry to form a screened slurry; a rotatable collection chamber containing a plurality of plates, a drive for rotating the collection chamber for collecting mercury on the plates to provide a discharge material comprising water and treated tailings, the treated tailings containing less mercury than in the feed material.

30 Claims, 4 Drawing Sheets

(56) References Cited

U.S. PATENT DOCUMENTS

| | | | | |
|---|---|---|---|---|
| 5,368,541 | A * | 11/1994 | Knelson | B04B 3/00 494/37 |
| 5,409,522 | A * | 4/1995 | Durham | B01D 46/0023 75/670 |
| 7,153,480 | B2 | 12/2006 | Bickham et al. | |
| 7,476,371 | B2 | 1/2009 | Richardson et al. | |
| 2011/0067525 | A1 * | 3/2011 | Reimchen | C22B 3/02 75/10.67 |
| 2014/0262954 | A1 | 9/2014 | O'Rear et al. | |

FOREIGN PATENT DOCUMENTS

| | | |
|---|---|---|
| WO | WO2008014884 | 7/2008 |
| WO | WO2011046307 | 4/2011 |
| WO | WO2017178323 | 10/2017 |

* cited by examiner

MERCURY COLLECTION SYSTEM

CROSS-REFERENCE TO RELATED APPLICATIONS

This application is a national phase entry of and claims priority to International Application No. PCT/US2020/057960, titled "Mercury Collection System." filed Oct. 29, 2020, the contents of which is incorporated by reference in its entirety.

BACKGROUND

Mercury contamination of soil and other materials such as tailings for mining is a known problem. For example, see United States Environmental Protection Agency report "Treatment Technologies for Mercury in Soil, Waste, And Water" of August, 2007. Such mercury contamination can contaminate water sources as a result of water runoff.

References that may be pertinent to such remediation are:

U.S. Pat. No. 5,013,358
U.S. Pat. No. 5,102,630
U.S. Pat. No. 5,183,499
U.S. Pat. No. 5,226,545
U.S. Pat. No. 5,244,492
U.S. Pat. No. 7,153,480
U.S. Pat. No. 7,476,371
US 20140262954
US 20110067525
WO17178323
WO2011046307
M. A. Ebadian, Ph.D., Mercury Contaminated Material Decontamination Methods: Investigation and Assessment, Hemispheric Center For Environmental Technology (HCEY), January 2001
Treatment Technologies for Mercury in Soil. Waste, and Water, U.S. Environmental Protection Agency, August, 2007
Michaud, Recovery of Mercury from Amalgamation Tailing, 2016

To the inventor's knowledge, there is no system available that effectively and economically removes mercury contamination from tailings.

SUMMARY

The present invention includes a system for effectively and economically collecting mercury from tailings. In general, the system comprises a feed material preparation system, a collection system for collecting mercury from feed material such as tailings, and a cleanup system for cleaning feed material from which mercury has been recovered.

The collection system utilizes an apparatus comprising a collection chamber having a wall and a longitudinal axis, and a feed material inlet for introducing feed material such as a slurry comprising water and tailings, into the collection chamber. The collection system includes a drive for rotating the collection chamber, and a plurality of plates in the chamber, each plate having an exterior surface formed of a collection material for collecting mercury from the feed material. Each plate is in a plane intersecting the longitudinal axis of the collection chamber. There is an outlet from the collecting chamber for discharging feed material from which mercury has been collected from the chamber. The collection material is copper, silver, gold, or combinations thereof. The apparatus preferably comprises a plurality of weirs extending inwardly from the chamber wall for improving mixing in the chamber and collection of mercury.

There can be a feed chamber upstream of the collection chamber and connected to the collection chamber to rotate with the collection chamber, with the feed material inlet connected to the feed chamber. The feed material can be a slurry comprising liquid and a solid, and the feed chamber can contain a material for comminuting the solid.

An organic compound such as glucose can be added to the feed material upstream of the collection chamber to reduce the mercury oxide in the feed material.

In a preferred version of the invention, the system includes an enclosure in which the collection chamber is located, and the chamber is removable from the enclosure for removing mercury from the plates. Frequently the collected mercury is an amalgam of a valuable material such as silver and gold, and recovery of the silver and gold helps make the system economical.

DRAWINGS

These and other features, aspects, and advantages of the present invention will become better understood with regard to the appended claims, the following description and the accompanying drawings, wherein:

DESCRIPTION

Figure 1:
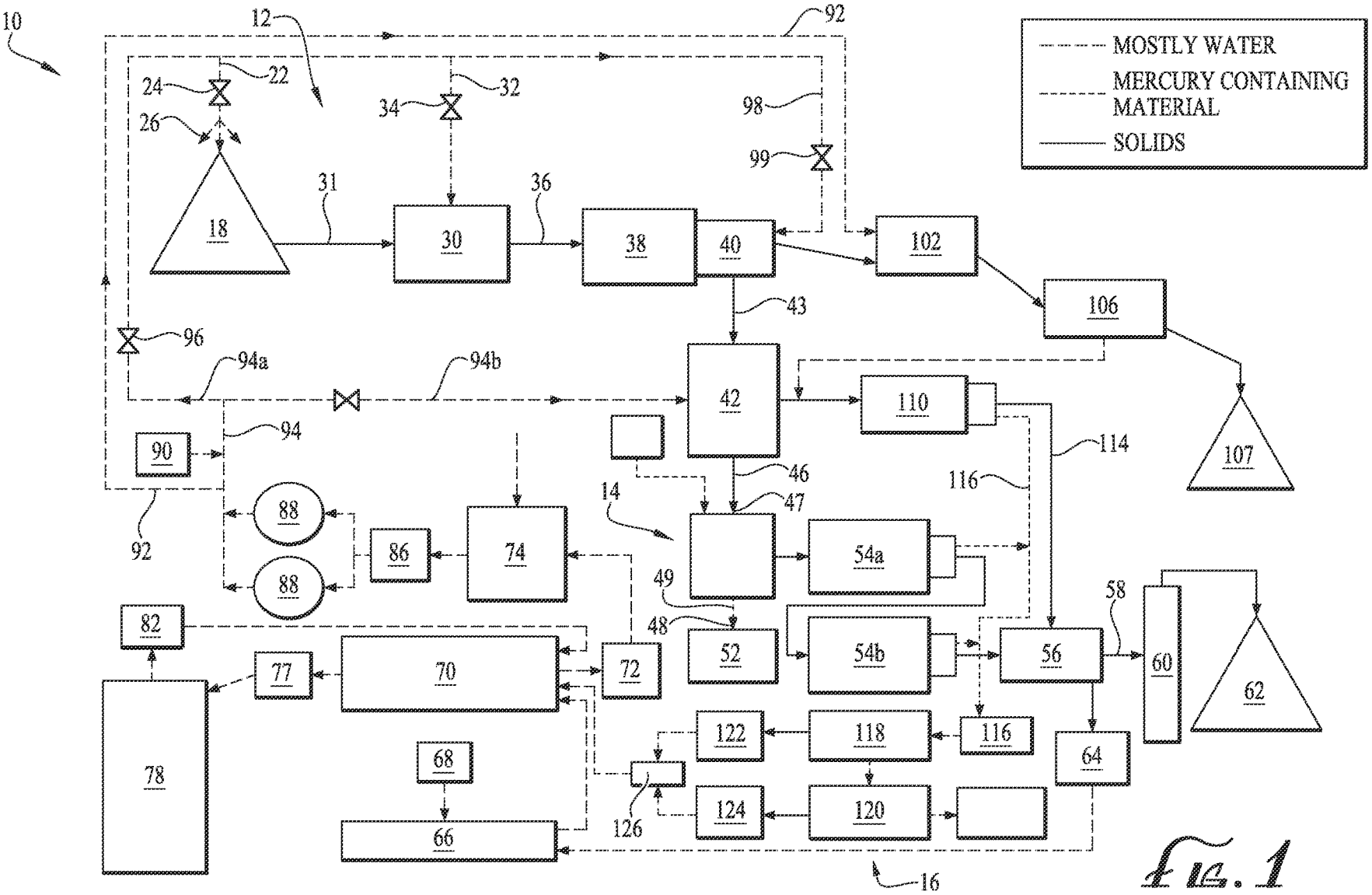
FIG. 1 is a flow chart of a system having features of the present invention.

With reference to FIG. 1, there is shown a system 10 for collecting mercury from tailings. Although the present invention is described in particular with regard to collecting mercury from tailings, the system is useful for other solid materials containing mercury, such as top soil having mercury contamination. The system 10 is particularly adapted for mercury from tailings, particularly tailings from gold mining where mercury was used for extracting gold from ore, as frequently there is residual gold and/or silver, whose recovery helps render the system 10 economical.

The system conceptually has three main components, namely a feed preparation system 12, a mercury collection system 14 for collecting mercury from the tailings, and a recovery system 16. The feed preparation system 12 is upstream of the mercury collection system 14, which is upstream of the recovery system 16.

All flows are by gravity unless indicated otherwise. The process is typically performed at ambient pressure and temperature, with no heating or cooling required. The lines used for transmitting materials can be made of any suitable material, including metals and plastics, such as polyethylene.

With regard to FIG. 1, a tailing pile 18 is the source of feed material. For dust control, the tailings can be sprayed with water from recycled water, described below, through line 22 and valve 24 through spray nozzles 26.

The tailings 18 can be hard rock or alluvial tailings and typically contain clay, sand stone, and gravel, with mercury bound in the clay. The tailings 18 can contain 30-50 grams of mercury compounds or amalgams per ton of feed. The tailings can be 40-90% by weight clay, and can have a diameter as large as 24 inches. A desirable tailing has at least some of the mercury in an amalgam with gold and/or silver such that 5% to 22% by weight of the mercury components is gold and about 1% to about 6% by weight is silver.

The tailings are fed to a feed hopper 30, preferably a wet vibration feed hopper, by a conveyor belt 31, with recycled water introduced to the hopper 30 through a line 32 through a valve 34. The feed rate is from about two to about five hundred tons per hour. Sufficient water is introduced into the feed hopper 30 such that the discharge from the feed hopper through a discharge line 36 is a slurry containing about 10% to about 50% weight water, and more preferably about 30-35% by weight water. The valve 34 can be a control valve tied to a sensor (not shown) for detecting the water content of the contents of the feed hopper 30 or the discharge line 36 from the feed hopper 30 to maintain the desired amount of water.

Rather than a vibratory feed hopper 30, optionally or in addition to the vibration, there can be mechanical mixing such as with a paddle mixer.

The slurry discharged from the feed hopper 30 through the discharge line 36 passes into a rotary scrubber 38 so that the clay in the feed material is in suspension or an emulsion, and then sequentially through a first screen 40 and a second screen 42 in series to remove particles greater than a selected size, such as ¼ in diameter, and preferably ⅛ in diameter, resulting in a feed for the collection system 14. For example, the first screen can screen out material greater than ⅜ inch in diameter and the second screen 42, which is preferably a vibratory single deck screen, can screen out material greater than ⅛ inch in diameter, resulting in a slurry feed material in line 46 from the second screen 42, the slurry feed material having particles of ⅛ inch in diameter and less. The slurry passes from the first screen 40 to the second screen 42 by gravity feed through line 43. The treatment of the screened-out particles in the slurry will be discussed below.

The slurry in line 46 passes to an inlet 47 to the mercury collection system 14. The mercury collection system 14, will be described in detail below with regard to FIGS. 2, 3A and 3B. The tailings fed into the collection system 14 contain a first percentage by weight mercury, and treated tailings discharged from the collection system 14 through an outlet 47 are discharged into line 48 and contain substantially no mercury or a second percentage by weight of mercury, wherein the second percentage is less than the first percentage, due to collection of mercury from the tailings.

The mercury recovered in the collection system 14 is represented in FIG. 1 by block 52.

The discharged material from the collection system 14 containing treated tailings is then processed to separate water from solids such as through one or more centrifuges such as a first 30 inch diameter low-G centrifuge 54*a* and a second 30 inch diameter low-G centrifuge 54*b* in series, with the solids in a concentrated slurry passing to a dewatering auger 56 with the solids thereafter passing through line 58 to a conveyor 60 and then collected in zone 62. The centrifuges minimize metallic mercury in the discharge. They hold mercury amalgamate in chambers, the mercury being removable by slowing down the centrifuges.

Water from the dewatering auger 56 passes into a slurry pump 64 and then is cleaned by flocculation in serpentine floc mix PCV bundle 66. Chemicals for use in flocculation are provided by a pump 68. Suitable flocculant agents include anionic and nonionic floc polymers such as anionic polyacrylamide and nonionic polyacrylamide, guar gum, and chitosan. Suitable coagulants for use in the bundle 66 include alum (aluminum sulphate), aluminum chlorhydrate, ferric chloride, ferric sulphate, diallyldimethyl ammonium chloride, poly diallyldimethyl chloride, and calcium oxide. These chemicals are injected via chem pumps directly into the serpentine mixer 66.

Suitable centrifuges 54*a* and 54*b* can be obtained from Oro Industries located in Marysville, Calif. under the brand name Low-G Horizontal Centrifuge.

After treatment by flocculation, the water passes into a dissolved air flotation unit 70 (DAF) available from Pro Tech International located in Colorado, USA. The DAF unit 70 separates residual solids from the processed water. Water from the dissolved air flotation unit 70 is pumped by pump a 72 into a treated water storage tank 74 for further use as described below.

The settled and floated solids, namely sludge, from the DAF unit 70 is pumped by a pump 77 to a sludge dewatering box 78. Water from the sludge dewatering box 78 can be pumped by pump 82 back into the DAF unit 70. The sludge is mixed with the other processed decontaminated tailing from the process plant and placed back into the location they came from, or tailings dump.

Water in the treated water storage tank 74 can be pumped by a pump 86 through sand filters 88 and then into water lines 92 and 94. There can be one or more sand filters, such as two sand filters 88 in parallel as shown in FIG. 1. The sand filters 88 can be filter bags of sand. When the filter bags are full of solids, they can be transported to the tailings dump 62 for disposal.

A reagent for assisting the collection of mercury in the mercury collection system 14, as described below, can be introduced by a pump 90 into water line 94. Optionally a venturi can be used instead of the pump 90.

Water passing through line 92 is fed into a sluice 102, wherein large sized particles from the first screen 40 are passed into the sluice 102. Preferably the sluice 102 is a ripple sluice.

Water line 94 has a first branch 94*a* with valve 96 through which water passes for optional feed to lines 22, 32, as described above, and also line 98 through a valve 99 into the first screen 40. Water line 94 has a second branch 94*b* for introducing water into the second screen 42.

The material from the sluice 102 passes through a dewatering sieve screen 106, where the solids, which are essentially tails greater than the size determined by the first screen 40, typically greater than ⅜ inch, are collected in zone 107. Water from the dewatering sieve screen 106 and particles from the second screen 42 are introduced into a centrifuge 110. The solids and water output from the centrifuge 110 is introduced into the dewatering auger 56 through line 114. Concentrated solids containing mercury from the centrifuge 110 pass through line 116, joining the solids from the first centrifuge 54*a* to flow into a venturi 116, and then from the venturi 116 into a multi-hex spiral cleaner 118, and from there into a multi-hex spiral finisher 120, with output from the spiral cleaner 118 into a first catch tank 122 and the output from the finisher 120 into a second catch tank 124. Water in the catch tanks 122 and 124 is pumped by pump 126 into the DAF unit 70 for further processing as described above. Suitable multi-hex spiral concentrators for the cleaner 118 and finisher are available from Oro Industries of Marysville, Calif.

Figure 2:
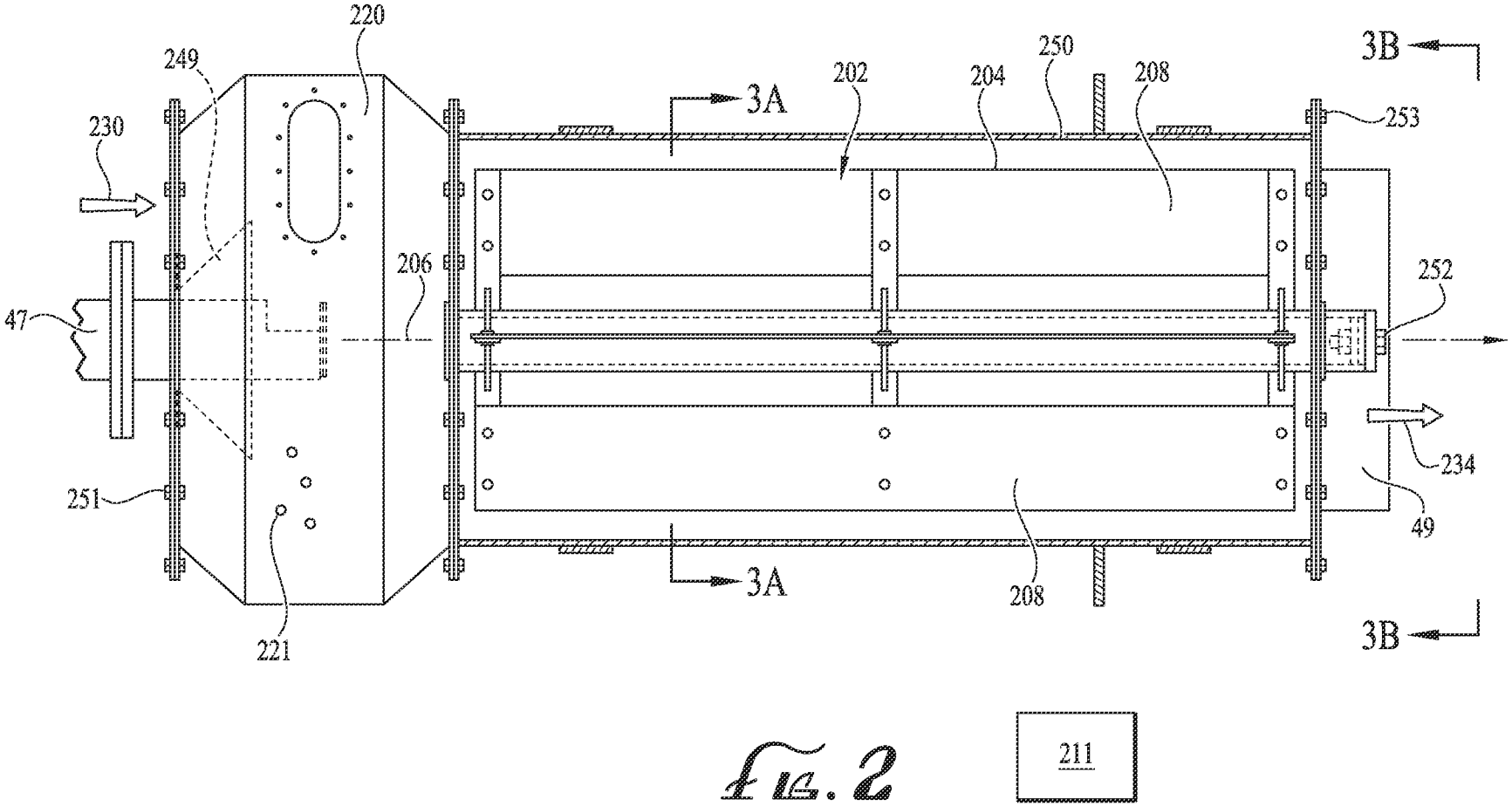
FIG. 2 is a side view, partly in section, of an apparatus for collecting mercury for use in the system of FIG. 1.
Figure 3B:
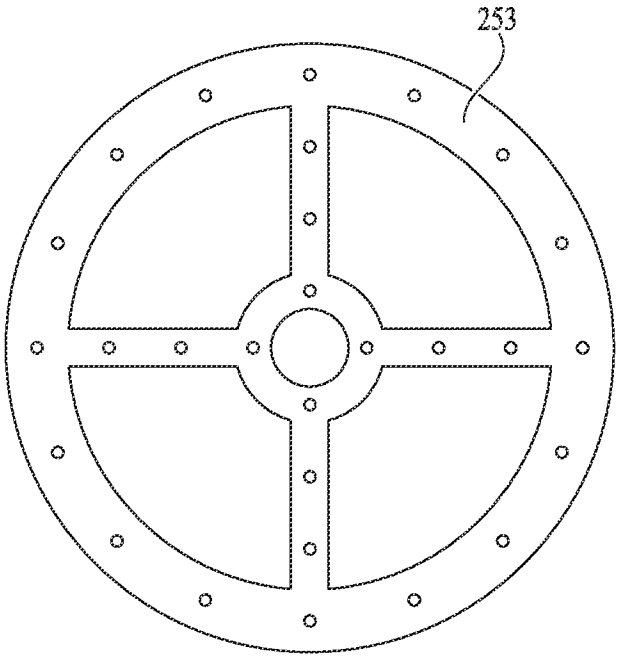
FIG. 3B is an end view of the apparatus of FIG. 2 taken on line 3B-3B of FIG. 3.
Figure 3A:
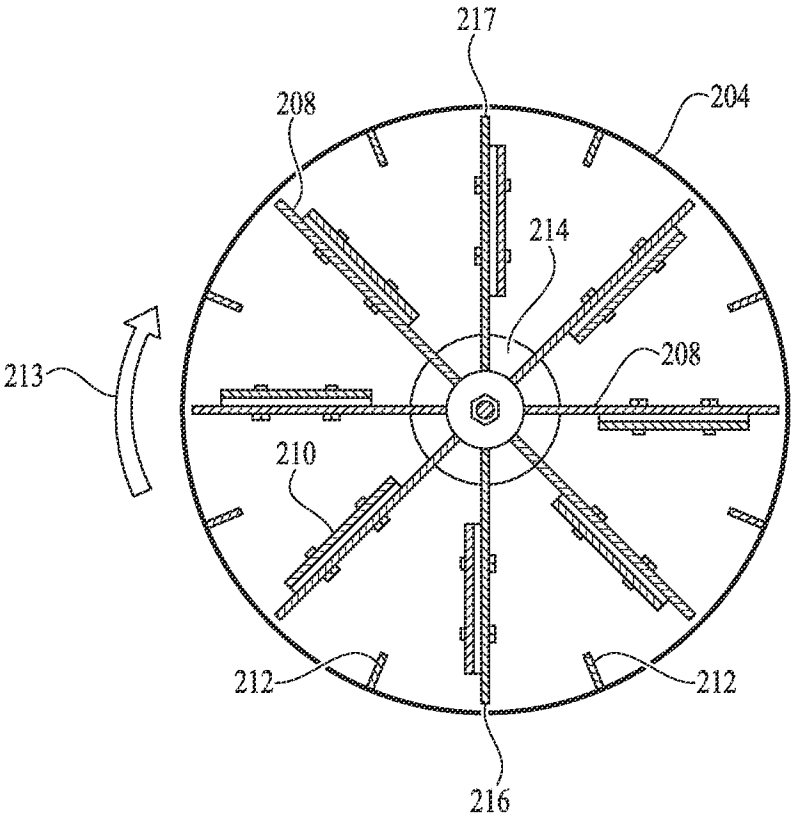
FIG. 3A is a sectional view of the apparatus of FIG. 2 taken on line 3A-3A of FIG. 2.

With regard to FIGS. 2, 3*a*, and 3*b*, the mercury collection system 14 comprises a rotatable collection chamber 202 having a circumferential wall 204 and a longitudinal axis 206. There are a plurality of plates 208 in the collection chamber 202, each plate 208 having an exterior surface 210 formed of a collection material for collecting mercury from the feed material. The plates can be formed of the collection material, have a coating of collection material, or have collection material fastened as shown in FIG. 3A. For example, the collection material can be provided on the surface of a core material such as steel, or a ceramic. Collection material may be on only one side of the plates as show in FIG. 3A, with the collection material on the forward side of the plates, i.e. the surface in front during rotation. The plates need not have a flat surface although a flat surface is preferred. All the plates need not be the same size. There optionally is a metallic mesh or other material on the outside of the plates 208 to provide a rough surface to provide improved collection. Optionally the exterior surface of the plates 208 can be roughened. There can be from about 4 to about 16 plates 208, and typically an even number for balance. Each plate 208 is in a plane intersecting the longitudinal axis 206.

The collection material is selected from the group consisting of copper, silver, gold and combinations thereof. Although silver and gold are more effective in collecting mercury and amalgams of mercury from the slurry in the chamber 202, copper is a preferred material because it is less expensive.

Rotation of the collection chamber 202 can be achieved with a drive 211 driving a friction belt (not shown). Typical rotation in the direction shown by arrow 213 in FIG. 3A at a rate of 5 to about 25 rpm.

Preferably there are a plurality of weirs 212, also referred to as lifters, extending inwardly from the chamber wall 204 to improve contact between the slurry containing mercury and the plates. The weirs extend radially inwardly about 5 to about 12 percent of the diameter of the chamber 202.

The plates can be mounted on a central hub 214 so they extend radially outwardly from the hub 214 toward the collection chamber wall 204, but leave a gap 216 between the end 217 of each plate and the chamber wall 204. For a chamber 202 two feet in diameter the gap 216 can be from about 1 to about 2 inches. For example, there can be a 2 inch gap 216 between the end of each plate and the chamber wall 204.

Preferably the chamber 202 is cylindrical such that a vertical cross section is circular, but other shapes are possible.

Preferably upstream of the collection chamber 202 and connected thereto is a feed chamber 220, also referred to as a mixing chamber, that rotates with the collection chamber. Material 221 can be used for comminuting the tailings in the feed chamber. Such materials as stones, steel balls, ceramic balls or other solid material can be used as the comminuting material. By comminuting the tailings, there is an increase in mercury recovery in that additional surface are of the tailing is exposed for mercury recovery.

In FIG. 2, arrow 230 shows the direction of feed material through the feed material inlet 47, typically about three to about four inches in diameter, and arrow 234 shows the direction of the output from the collection chamber through the outlet 49, typically about sixteen inches in diameter. As shown the feed material inlet 47 feeds the feed material into the collection chamber 202 via the feed chamber 230, but in versions of the invention where there is no feed chamber 230, the feed material inlet 237 feeds the feed material directly into the collection chamber 202.

A cone shaped seal 249 prevents leakage from the feed chamber 230. A header 251 is on the feed side of the feed chamber 230, and another header 253 is on the discharge side of the collection chamber.

The collection chamber 202 is within an enclosure 250, and is held in place by a bolt 252. Releasing the bolt 252 allows the collection chamber 202 to be removed from the enclosure 250 in the direction shown by arrow 254 so that mercury and mercury amalgams collected on the plates 208 can be scraped off and collected. Thus, although the process as described is a continuous process, it is a batch process in the sense that periodically the process stops so that the mercury can be removed from the plates 208. Optionally the plates can be recoated with mercury from a mercury pump and preferably there is collection material on both sides of the plates.

Mercury can be introduced by an optional pump 302 into the collection system for providing a starter coating of mercury as the collection material on the plates.

The reagent pumped by the pump 90 can be introduced through any water line upstream of the collection chamber of the mercury collection system. The amount of reagent is from about 0.1 to about 1 gram/liter of water in the slurry fed into the collection system. Suitable reagents are biodegradable organic compounds such as glucose, fructose, maltose, sucrose, and dextrose to reduce mercury compounds in the tailings. The use of the reagent is optional. The amount of reagent used is from about 0.1 to 1 gram per liter of water introduced to form the slurry.

It is desirable that pH of the material in the collection system 14 be from about 4 to about 9, and more preferably from about 4 to about 6, to maximize recovery of mercury from the feed material. A pH in this range improves leaching of mercury sulphites from the feed material. The pH can be adjusted to the desired range by increasing the pH with a base such as calcium hydroxide or sodium hydroxide, or an acid such hydrochloric acid to reduce the pH.

Figure 4:
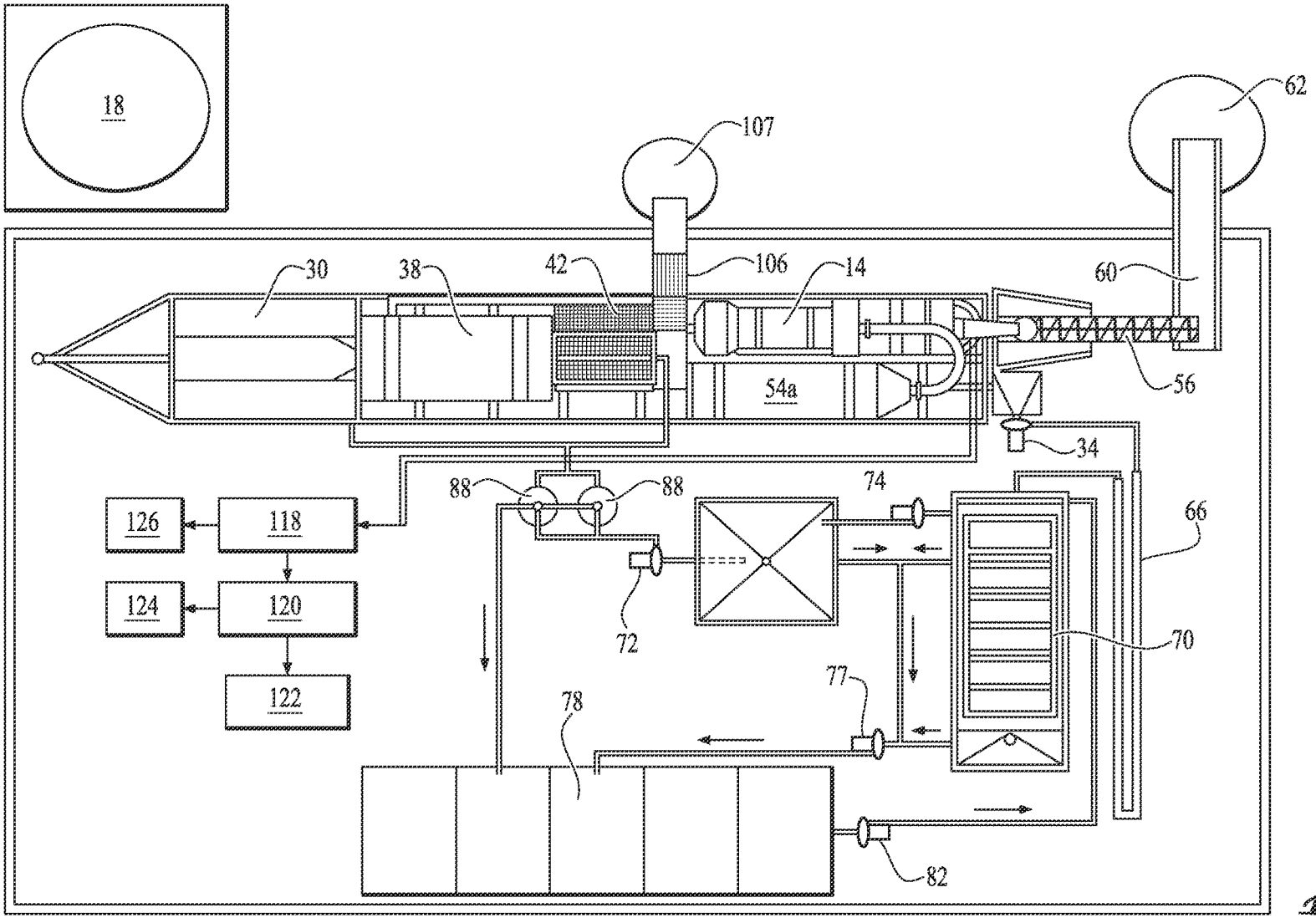
FIG. 4 is a layout view of equipment useful for practicing the system shown in FIG. 1.

FIG. 4 shows a layout of equipment suitable for clearing out the process shown in FIG. 1, where same reference numbers used in FIG. 1 are used in FIG. 4. The equipment can all fit on a trailer for towing into place by a truck so the system can be used at different sites.

Example (Prospective)

The source material is tailings containing 5 grams per ton of mercury, 1 gram per ton gold, and 1.5 grams of silver per ton. The tailings are fed at a rate of 25 tons/hr. The tailings are combined with water to provide a slurry having about 25 percent by weight water, and the tailings are screened to provide a feed material where particles are ⅛ inch or less in diameter. The slurry is fed to the mercury recovery system along with a reducing reagent in an amount of 4000 grams per ton of tailings, and mercury is recovered and the water is cleaned up. Ninety percent of the mercury, ninety percent of the gold, and ninety percent of the silver in the tailings are recovered. The mercury can be retorted (distillation) to recover metallic mercury.

Although the present invention has been described in considerable detail with regard to certain preferred versions thereof, other versions are possible. Therefore, the scope and appointed claims should not be limited to the described in the preferred versions contained herein.

What is claimed is:

1. Apparatus for collecting mercury from a feed material containing mercury, the apparatus comprising:

a) a rotatable collection chamber having a wall and a longitudinal axis;

b) a feed material inlet for introducing the feed material into the chamber c) a drive for rotating the chamber;

d) a plurality of plates in the chamber, each plate having an exterior surface formed of a collection material for collecting mercury from the feed material, each plate being in a plane intersecting the longitudinal axis, wherein the collection material is selected from the group consisting of copper, silver, gold, and combinations thereof; and e) an outlet from the chamber for having feed material from which mercury has been collected removed from the chamber.

2. The apparatus of claim 1 comprising a plurality of weirs extending inwardly from the chamber wall.

3. The apparatus of claim 1 comprising a feed chamber upstream of the collection chamber and connected to the collection chamber to rotate with the collection chamber.

4. The apparatus of claim 3 wherein the feed material inlet is connected to the feed chamber.

5. The apparatus for claim 3 wherein the feed material is a slurry comprising liquid and a solid, and wherein the feed chamber contains a material for comminuting the solid.

6. The apparatus of claim 1 inside an enclosure and wherein the apparatus is removable from the enclosure for removing mercury from the plates.

7. A system comprising the apparatus of claim 1 with a water inlet upstream of the collection chamber and a line for introducing water to the water inlet.

8. The apparatus of claim 1 wherein the feed material is a slurry and the feed material inlet is adapted for introducing a slurry into the chamber.

9. A method for collecting mercury from a feed material comprising the steps of:

a) feeding the feed material into the collection chamber of the apparatus of claim 1 through the feed material inlet;

b) rotating the collection chamber with the drive;

c) collecting mercury on the exterior surface of the plates thereby producing a discharge material containing less mercury than the feed material; and d) withdrawing the discharge material from the collection chamber through the outlet.

10. The method of claim 9 wherein the apparatus includes a feed chamber upstream of the collection chamber, and step (a) comprises feeding the feed material into the feed chamber and step (b) comprises rotating the feed chamber with the collection chamber.

11. The method of claim 9 wherein the feed material comprises a solid and the apparatus comprises a material for comminuting the solid in the feed chamber, and wherein rotation of the feed chamber results in comminution of the solid.

12. A method for collecting mercury from a feed material comprising the steps of:

a) feeding the feed material into the chamber of the apparatus of claim 6 through the feed material inlet;

b) rotating the chamber with the drive;

c) collecting mercury on the exterior surface of each plate, thereby producing a discharge material containing less mercury than the feed material;

d) withdrawing the discharge material from the chamber through the outlet;

e) removing the apparatus from the enclosure; and f) after step (e), removing mercury from the plates.

13. A method for collecting mercury from tailings comprising the steps of:

a) forming a slurry comprising the tailings and water, wherein the tailings in the formed slurry are less than ¼ inch in diameter, and wherein the tailings in the slurry contain a first percentage by weight of mercury;

b) introducing the slurry into a rotatable collection chamber containing a plurality of plates, each plate having an exterior surface with a collection material thereon, the collection material selected from the group consisting of gold, silver, and copper, each plate having mercury on an exterior surface;

c) rotating the chamber wherein mercury collects on the plates providing a discharge material comprising water and treated tailings, the treated tailings containing substantially no mercury or a second percentage by weight of mercury, the second percentage being less than the first percentage;

d) discharging the discharge material from the chamber; and e) separating the water from the treated tailings.

14. The method of claim 13 wherein the mercury collected on the plate comprises an amalgam comprising mercury with gold or silver or both gold and silver.

15. The method of claim 13 wherein the collection chamber is in an enclosure, and the method comprises the steps of removing the chamber from the enclosure and thereafter removing mercury from the plates.

16. The method of claim 13 wherein the tailings comprise mercury oxide, and the method comprises the step of including in the slurry an organic compound to reduce the mercury oxide.

17. The method of claim 16 wherein the organic compound comprises glucose.

18. The method of claim 17 wherein the step of including comprises introducing the organic compound into the slurry before step (b).

19. A system for collecting mercury from tailings, the tailings containing a first percentage by weight of mercury, the system comprising:

a) a water inlet for forming a slurry containing the tailings;

b) at least one screen for separating tailings greater than ¼ inch in diameter from the slurry to form a screened slurry;

c) a rotatable collection chamber having a longitudinal axis and containing a plurality of plates, the plates extending in a direction to intersect the longitudinal axis;

d) a collection chamber inlet for introducing the screened slurry into the chamber;

e) a drive for rotating the collection chamber for collecting mercury on the plates to provide a discharge material comprising water and treated tailings, the treated tailings containing substantially no mercury or a second percentage by weight of mercury, the second percentage being less than the first percentage;

f) an outlet from the collection chamber for discharging the discharge material from the collection chamber; and g) a separation system for separating the treated tailings from the water in the discharge material.

20. The system of claim 19 wherein the collection chamber comprises a wall and a plurality of weirs extending inwardly from the chamber wall.

21. The system of claim 19 comprising a feed chamber upstream of the collection chamber and connected to the collection chamber to rotate with the collection chamber and in fluid flow with the chamber inlet for introducing the screened slurry into the collection chamber.

22. The system for claim 21 wherein the feed chamber contains a material for comminuting the solid.

23. The system of claim 19 wherein the collection chamber is inside an enclosure, and wherein the collection chamber is removable from the enclosure for removing mercury from the plates.

24. The system of claim 19 comprising a water inlet upstream of the collection chamber and a line for introducing water to the water inlet.

25. The system of claim 19 comprising an inlet for an organic material for introducing an inorganic compound for reducing mercury compounds in the tailings, the inlet for the organic material being upstream of the collection chamber.

26. The apparatus of claim 1 wherein the plates are made of copper, silver, gold or combinations thereof.

27. The apparatus of claim 26 wherein the plates are made of copper.

28. The method of claim 13 wherein the collection material is copper, silver, gold or combination thereof.

29. The apparatus of claim 28 wherein the collection material is copper.

30. The apparatus of claim 1 wherein the plates extend radially from a central hub towards the wall, with a gap between the wall and the end of the plates.

* * * * *